US006290125B1

(12) United States Patent
Breda

(10) Patent No.: US 6,290,125 B1
(45) Date of Patent: Sep. 18, 2001

(54) COMPARTMENTED PACKAGING

(75) Inventor: Mélanie Breda, Boulogne Billancourt (FR)

(73) Assignee: Jerome Augui, Boulogne Billancourt (FR)

( * ) Notice: Subject to any disclaimer, the term of this patent is extended or adjusted under 35 U.S.C. 154(b) by 0 days.

(21) Appl. No.: 09/303,572

(22) Filed: May 3, 1999

(30) Foreign Application Priority Data

Nov. 6, 1998 (FR) ..... 98 13980

(51) Int. Cl.[7] ..... B65D 5/48; B65D 5/60

(52) U.S. Cl. ..... 229/120.07; 206/461; 206/469; 229/164.2; 53/456; 53/474

(58) Field of Search ..... 229/120.07, 164.2; 220/62.18, 62.22, 528, 732, FOR 174, FOR 175; 206/461, 469, 820; 53/456, 473, 474

(56) References Cited

U.S. PATENT DOCUMENTS 4,320,846 * 3/1982 Meyering et al. ..... 206/820
4,911,304 * 3/1990 Bunin ..... 206/469
5,194,315 * 3/1993 Itoh ..... 220/732
5,706,969 * 1/1998 Yamada et al. ..... 220/62.18
5,762,198 6/1998 Hung ..... 206/522
5,769,232 6/1998 Scott ..... 206/522
5,857,564 * 1/1999 Hymowitz ..... 206/820

FOREIGN PATENT DOCUMENTS 2446780 8/1980 (FR) .
1302555 1/1973 (GB) .

* cited by examiner

*Primary Examiner*—Gary E. Elkins
(74) *Attorney, Agent, or Firm*—Young & Thompson

(57) ABSTRACT

A package comprising a first wall forming a blank of the package which is folded to produce a three-dimensional main package. A second wall is welded, glued or otherwise applied to the surface of at least one panel inside the first wall of the package to create a double wall on that panel forming a peripheral container.

21 Claims, 4 Drawing Sheets

COMPARTMENTED PACKAGING

BACKGROUND OF THE INVENTION

1. Field of the Invention

The invention concerns packaging. It is more particularly concerned with parallelepiped-shaped packages or boxes for products such as bottles, but also prismatic and even cylindrical packages and boxes.

2. Description of the Prior Art

The present invention consists in a simple and economical new package offering technical and commercial advantages over existing products.

SUMMARY OF THE INVENTION

The present invention consists in a package comprising a first wall forming a blank of the package adapted to be folded to produce a three-dimensional package, and a second wall welded or glued to the surface of at least one inside panel or face of the first wall of the package to create a double wall on that face to define a peripheral container.

Accordingly, each side panel and the bottom panel and the lid panel of the package may have the double-wall structure forming a peripheral container into which an associated product can be loaded or inserted. This advantageously enables the packaging and marketing or distribution of samples of a number of other products in addition to the main product which is purchased by the consumer.

It is also clear that the peripheral containers, once filled and closed, advantageously protect the main product.

Providing the peripheral containers on an inside panel or face of the package means that the exterior appearance of the main packaging does not need to be modified.

In a preferred embodiment, the second wall is fixed to the first wall to create a sealed area able to receive fluid products.

One or more cavities are thus provided, defined by fillable double wall structures, also referred to as peripheral containers.

Accordingly, the package is easy to use and low in cost because it requires only cutting or blanking out and heat-welding or gluing operations.

This is particularly advantageous in the cosmetics field in particular, since means for carrying out these steps are readily available.

In a preferred embodiment of the invention the second wall is made of a flexible material, preferably a plastics material. It can, alternatively, be made of metal, cardboard or multilayer composite materials.

In a preferred embodiment the peripheral containers each form one panel of the package which can be separated from other panels when the package has been opened. Accordingly, at least one peripheral container is separated from other panels or peripheral containers to obtain a separate sachet or packet containing the auxiliary product or sample, which is the equivalent of taking apart the original package.

In one particular embodiment, the bending lines in the outside wall along which it is bent to form the main package include lines of perforations or weakness to enable the peripheral containers constituting the panels of the initial package to be separated.

In one embodiment the bending lines are adapted to severe or tear along a weakened line of the sheet material.

This feature takes advantage of a fact that merely by folding the package into its parallelepiped or prismatic shape, weakened lines are formed at edges in the sheet material defining the panels of the package along which it is easy to tear the sheet material.

In one embodiment the package includes on the inside wall peripheral container opening starter means to facilitate opening of the peripheral containers and access the auxiliary products therein.

In a preferred embodiment the package includes a coating on the inside surface of one first wall compatible with and impervious to liquid, solid or gaseous auxiliary products, to be contained in the double-walled structures.This ensures any damage to the outer wall of the main package by the sample(s) in the peripheral wall enclosure(s).

The invention is also directed to a method of manufacturing packaging adapted to contain a main product and one or more auxiliary products, including the following operations:

- cutting out a blank forming a first or outside wall of a package from semi-rigid sheet materials, the blank incorporating folding lines,
- cutting out a blank forming a second or inside wall from a flexible sheet material,
- assembling the inside wall to the outside wall along at least one assembly line to form the contour of at least one peripheral container,
- filling and then sealing the at least one of the peripheral container, and
- bending the resulting assembly of the finished second walls to form the packaging for the main product.

The invention is also directed to a method of packaging a main product comprising an operation of forming the package as set out hereinabove and operations of loading an auxiliary product into at least one peripheral container, closing the at least one peripheral container once filled and bending the walls along the bending lines to form a box for the main product.

The following description and drawings show clearly the aims and advantages of the invention. It is clear that the description is given by way of example only and is not limiting on the invention.

DETAILED DESCRIPTION OF THE PREFERRED EMBODIMENT

Figure 1:
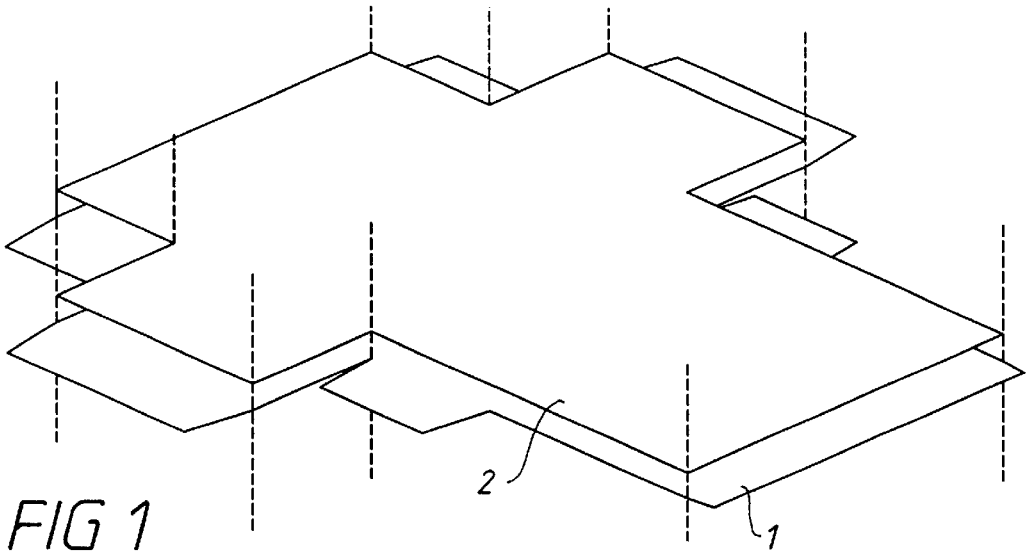
FIG. 1 is a perspective view of two sheets of material for constituting the package.

The general context of the invention is that of packaging a main product, the purchase made by a customer, this product also being referred to as the "central" product by virtue of its location within the main package, and auxiliary objects or products that can be marketed or given away in the form of trial quantities, e.g. samples. The package is of the box type whether parallelepipedic, prismatic or even cylindrical and has at least three side walls in the case of a parallelepipedic or prismatic box, a bottom wall and a lid, each defining a corresponding panel The package is formed from a first sheet of material adapted to form an outside wall 1 of the package, this sheet being folded to the required shape of the box. The package also employs a second, inner sheet adapted to form an inside wall 2 (FIG. 1).

Figure 2A:
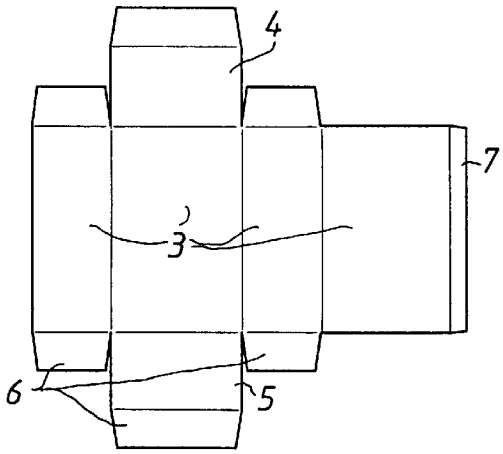
FIGS. 2*a* through 2*f* are plan views showing various steps of preparation of the package before bending.

The outside wall 1 constitutes the blank for the package. It is therefore cut out conventionally and its geometry depends on the size and shape of central or main product to be packaged. In a conventional manner, and as seen clearly in FIG. 2*a*, when the package is folded into a rectangular parallelepiped shape it has four rectangular panels 3 adapted to form the sides of the package, a panel adapted to form the lid 4 and a panel adapted to form the base 5. It also has flaps 6 (of which here there are three around the panel forming the lid and three around the area forming the base of the package) and a gluing tab 7 for gluing the package together in the assembled position.

Figure 2B:
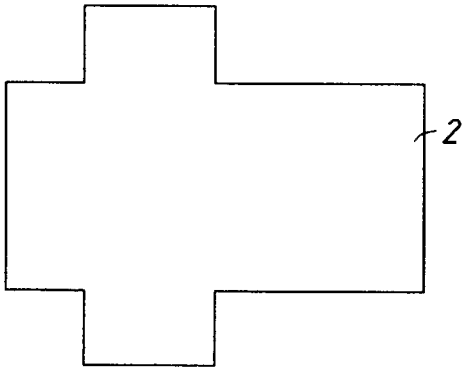
Figure 2C:
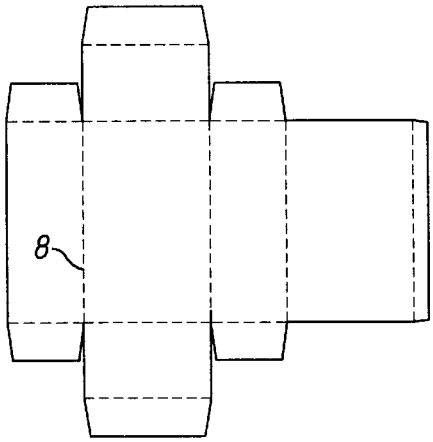

The various panels forming the blank for the outside wall 1 are delimited by folding lines 8 (see FIG. 2*c*).

The outside wall 1 is made from a rigid or semi-rigid material suitable for the packaging and storage (stacking, for example) of the main product and appropriate for the overall appearance. For this reason it is preferably made of cardboard. It can, alternatively, be made from a relatively rigid plastics material (for example polyethylene or PVC), or even metal. The inner face of the outside wall 1 adapted to face the interior of the product, when assembled, is preferably coated with a thin plastics film that is impermeable to the usual cosmetic or liquid products (or even air) to be contained in the peripheral containers and therefore protects the outside wall 1.

The inside wall 2 need only be partially overlie the surface of the outside wall 1 (for example it will not normally be necessary to cover the flaps 6). Also, depending on the number of peripheral containers desired, a corresponding number of panels needs to be covered. The shape of the inside wall also depends on the products to be accommodated in the peripheral containers of the package. As shown in plan view in FIG. 2*b*, it may be cruciform in shape with six areas identical in shape to the panels of the outside wall 1 adapted to form the faces of the package.

The inside wall 2 is preferably made from flexible sheet material for two main reasons. First, such a material contributes to the elasticity of the package for absorbing impacts, which enhances the protection of the central product. Also, the resulting multilayer assembly (outside wall 1, sample product, flexible inside wall 2) locates and immobilizes the central product. Second, because of its flexibility various auxiliary products may be accommodated between it and the rigid or semi-rigid outside wall, within double-walled structure defined in this way.

In the non-limiting example described here the inside wall 2 is made from a flexible plastics material film (for example polyethylene or PVC) such as those currently used for sachets for packaging cosmetic product samples. The inside wall 2 can be printed over part of its surface, for example with the logo of the auxiliary product or user information.

Any conventional methods in the art for blanking or cutting out the outside walls 1 and the inside walls 2 may be employed.

The outside walls 1 and inside walls 2 are then superposed (FIG. 2*c*) and thereafter welded or glued together along lines near the folding lines 8 (FIG. 2*d*), thus defining in the space between the outside wall 1 and the inside wall 2 peripheral containers 9 that can receive various auxiliary products.

Fixing by heat-welding is initially performed along only, say, three of four sides of each face to enable the filling of the product into the peripheral container 9, the remaining being open.

In a more fanciful embodiment the two walls can be welded together to define the contour of a design. For example the design welded into a wall can reproduce the outline of the distinctive bottle corresponding to the sample included in the peripheral package.

The folding lines 8 may be weakened by perforations to enable easy tearing of the package along these lines to separate one or more peripheral containers 9 from the rest of the package.

Figure 2E:
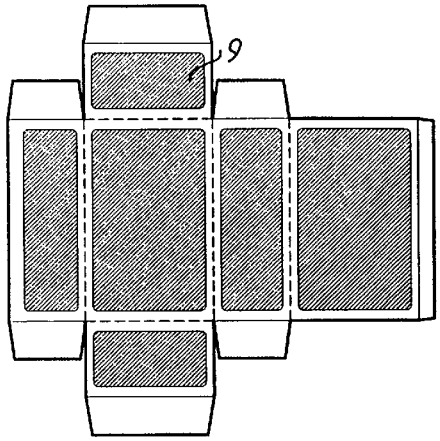
Figure 2D:
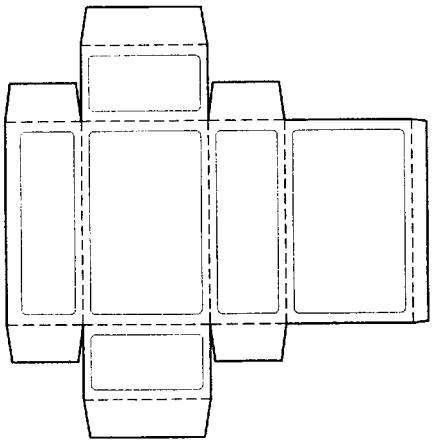

After one or more peripheral containers have been filled with the desired product (cosmetics samples, for example) as shown in FIG. 2*e*, the open side of the peripheral container(s) 9 is heat-welded closed as is known per se.

Figure 2F:
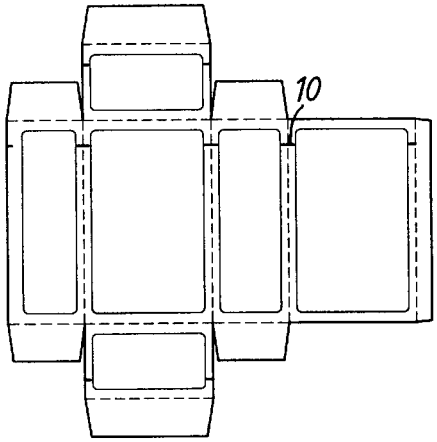

Precut lines 10 may be provided on a face of the panel (FIG. 2*f*) to facilitate opening the peripheral container 9 on that face. It is equally possible to provide pull-tabs or other devices to facilitate opening.

Figure 3A:
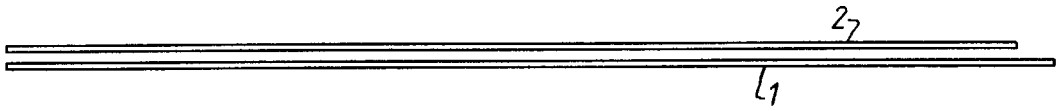
FIGS. 3*a* through 3*c* are sectional views showing various steps of preparation of the package before bending.
Figure 3B:
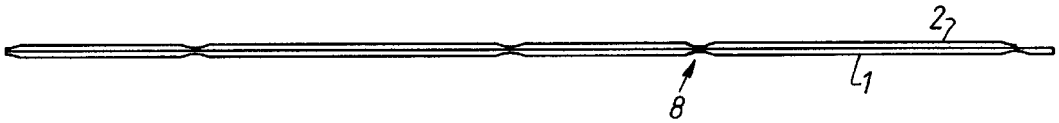
Figure 3C:
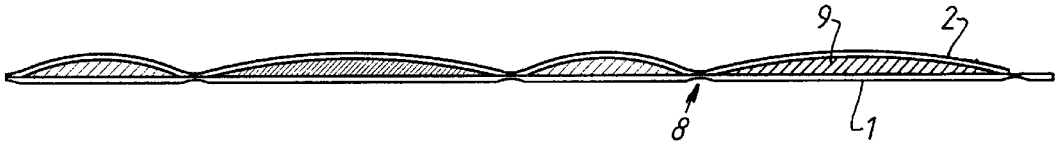

FIG. 3 is a sectional side view of the outside and inside walls 1 and 2 before they are assembled together (FIG. 3*a*), during heat-welding (FIG. 3*b*) and after the peripheral container or containers is or are filled with the auxiliary product(s) (FIG. 3*c*).

Figure 4:
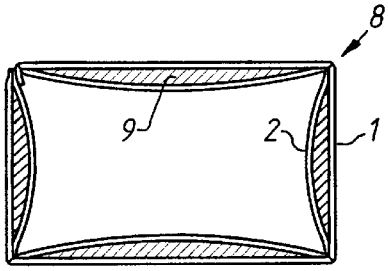
FIG. 4 is a sectional plan view of the folded package.

FIG. 4 shows the panels once the package has been assembled, here forming a box of rectangular section. Note that the auxiliary products form "padding" protecting the central product (not shown in the figure) from external impact, for example when the side panels are used as peripheral containers.

Figure 5:
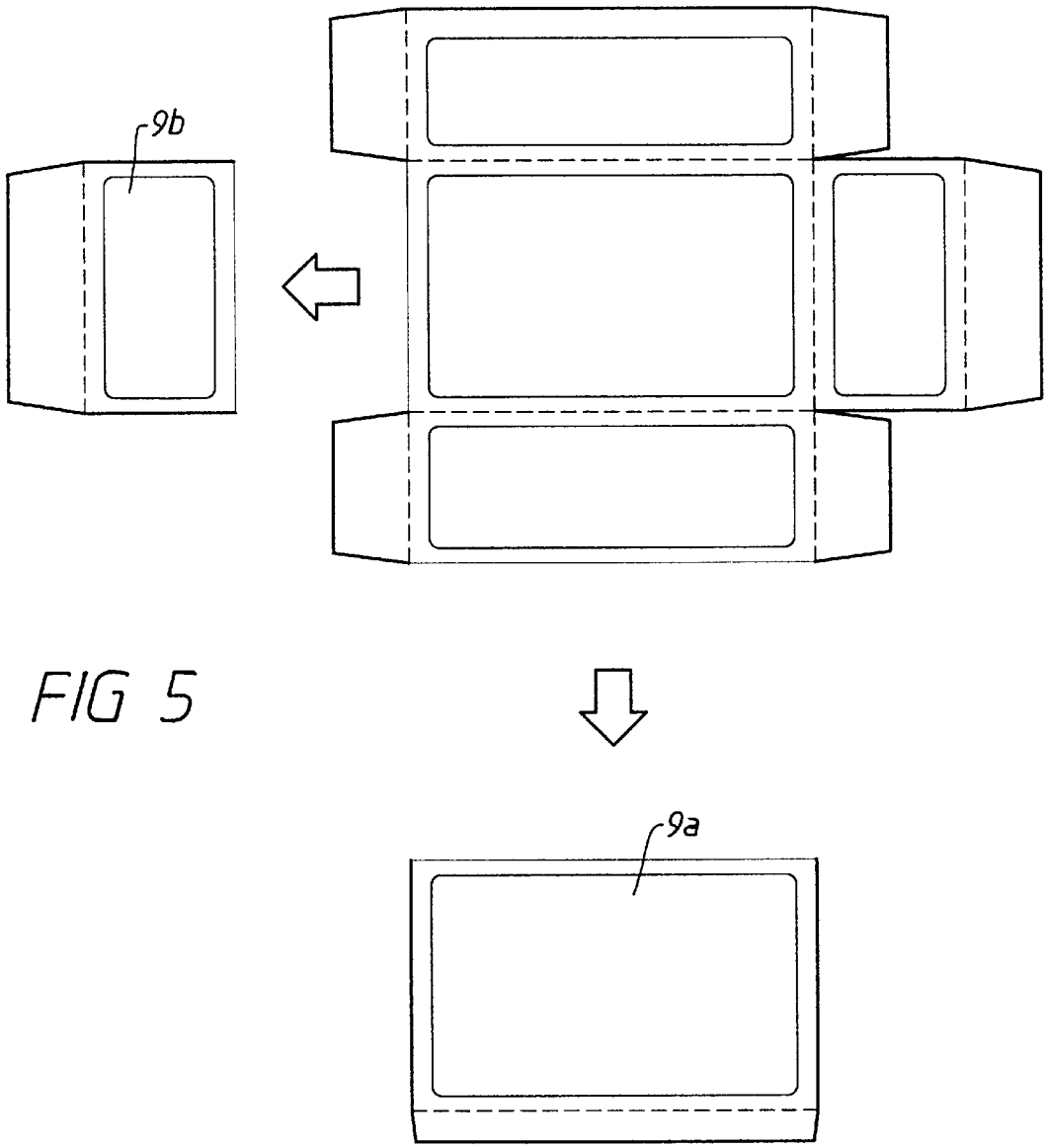
FIG. 5 shows the separation of one peripheral container from the package.

FIG. 5 shows the separation of some peripheral containers (9*a*, 9*b*) from the package after the purchaser opens the main package to access and remove the main product.

It follows from the above description that the device described has the advantage of being suitable for use in various situations, such as:

- to promote products other than the main purchased by virtue of the detachable peripheral containers constituting product samples;
- to enhance and improve the use of the product purchased by means of the products contained in the peripheral containers;
- to constitute a free gift, not necessarily having any relation to the use of the main product;
- to immobilize and protect the main product, the peripheral containers being filled for example with air to form an air cushion. The immobilizing and impact protection features obtained with peripheral containers filled with air can also be produced when the peripheral containers are filled with liquid, porous, granular or pulverulent materials, thus combining various functions of this type of packaging; and
- to provide specific packaging for the main product by virtue of particular properties of the products contained in the peripheral containers, such as heat-retaining gels.

In one variant (not shown), the flexible wall 2 may be the rigid outside wall 1 and the samples are then visible on the outside of the package.

The scope of the present invention is not limited to the details of the embodiments discussed hereinabove by way of example but to the contrary extends to modifications that will be evident to one ordinarily skilled in the art.

There is claimed:

1. A compartmented package comprising a main three dimensional packaging including a plurality of panels connected to one another, at least one of the panels having a double wall structure, the double wall structure being sealed and defining a peripheral compartment containing an auxiliary product, and means for opening the peripheral compartment and dispensing the auxiliary product sealed therein.

2. A compartmented package claimed in claim 1, wherein the double wall structure comprises a panel wall sealed to a wall of flexible sheet material.

3. A compartmented package claimed in claim 1, wherein said at least one panel is separable from one or more other panels of said plurality of panels.

4. A compartmented package claimed in claim 1, wherein the folding lines between adjoining ones of said plurality of panels incorporate a series of perforations.

5. A compartmented package claimed in claim 1, wherein said means for opening the peripheral compartment includes means on an inside wall of said double wall structure means for starting the opening of the peripheral compartment.

6. A compartmented package claimed in claim 1, wherein the auxiliary product is a liquid or a semi-liquid.

7. A compartmented package claimed in claim 1, wherein the auxiliary product is a cosmetic product.

8. A compartmented package claimed in claim 1, wherein the auxiliary product is a trial sample.

9. A compartmented package claimed in claim 1, wherein two or more of said plurality of panels have said double wall structure and there are two or more peripheral compartments containing the auxiliary product or two or more auxiliary products, said two or more peripheral compartments being individually sealed.

10. A package comprising a first wall defining a main three-dimensional folded package having a plurality of panels, a second wall secured to an inside surface of at least one of said panels to form a double wall structure with said at least one panel, thereby defining a peripheral container for receiving an auxiliary product, the peripheral container being separable from one or more other panels once the main package has been opened.

11. The package claimed in claim 10, wherein said second wall is fixed to said first wall so as to define a sealing area for sealing fluid products inside said double wall structure.

12. The package claimed in claim 10, wherein said second wall is made of a flexible sheet material.

13. The package claimed in claim 10, wherein said second wall is made of a flexible plastics sheet material.

14. The package claimed in claim 10, wherein folding lines between adjoining panels of said first wall incorporate a series of perforations.

15. A package comprising a first wall defining a main three-dimensional folded package having a plurality of panels, a second wall secured to an inside surface of at least one of said panels to form a double wall structure with said at least one panel, thereby defining a peripheral container for receiving an auxiliary product, folding lines of said outside wall folded to form the main package incorporating a series of perforations.

16. The package claimed in claim 15, wherein said second wall is made of a flexible sheet material.

17. The package claimed in claim 15, wherein said second wall is made of a flexible plastics sheet material.

18. The package claimed in claim 15, wherein folding lines between adjoining panels of said first wall incorporate a series of perforations.

19. A method of making a dual package adapted to contain a main product and one or more auxiliary products, including the steps of:

providing a first blank of semi-rigid sheet material for forming an outside wall of a main package, the first blank incorporating folding lines defining panels;

providing a second blank of flexible sheet material for forming an inside wall;

assembling the inside wall to the outside wall along at least one assembly line to define at least one peripheral container;

providing means for opening the peripheral compartment;

filling the at least one peripheral container with a sample of an auxiliary product;

closing the at least one peripheral container thus filled; and folding the outside wall along the folding line to form a boxlike package for receiving a main product, whereby the auxiliary product can be dispensed by opening the peripheral compartment.

20. The method claimed in claim 19, wherein the at least one peripheral container is separable from the rest of the boxlike package.

21. A method of making a package adapted to contain a main product and one or more auxiliary products, including the steps of:

providing a first blank of semi-rigid sheet material for forming an outside wall of a main package, the first blank incorporating folding lines defining panels;

providing a second blank of flexible sheet material for forming an inside wall;

coating an inside face of the outside wall with an impervious coating material;

assembling the inside wall to the outside wall along at least one assembly line to define at least one peripheral container;

filling the at least one peripheral container with a sample of an auxiliary product;

closing the at least one peripheral container thus filled; and folding the outside wall along the folding line to form a boxlike package for receiving a main product.

* * * * *